US008661953B2

(12) United States Patent
Corcoran

(10) Patent No.: US 8,661,953 B2
(45) Date of Patent: Mar. 4, 2014

(54) PAPER TRIMMER WITH ADJUSTABLE STOP

(75) Inventor: Kevin L. Corcoran, Mission Viejo, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 1432 days.

(21) Appl. No.: 12/157,129

(22) Filed: Jun. 9, 2008

(65) Prior Publication Data

US 2009/0300924 A1 Dec. 10, 2009

(51) Int. Cl.
*B26D 5/00* (2006.01)

(52) U.S. Cl.
USPC ..... 83/391; 83/467.1; 83/564; 83/614; 83/616; 83/628; 83/632; 83/633

(58) Field of Classification Search
USPC ..... 30/292; 83/564, 597, 628, 633, 635, 83/636, 614, 697, 607, 602, 391, 392, 397, 83/467.1, 468.1, 468.7, 563, 566, 569, 83/831, 616, 632, 613, 624, 625, 626
See application file for complete search history.

(56) References Cited

U.S. PATENT DOCUMENTS

| | | | | |
|---|---|---|---|---|
| 2,254,374 | A * | 9/1941 | Alfred | 83/387 |
| 2,790,498 | A * | 4/1957 | Carscallen | 83/383 |
| 3,089,373 | A * | 5/1963 | Fischer et al. | 83/468 |
| 5,287,783 | A * | 2/1994 | Mori | 83/455 |
| 5,671,647 | A * | 9/1997 | Mori | 83/56 |
| 6,460,443 | B1 * | 10/2002 | Hsiao | 83/614 |
| 6,776,077 | B1 * | 8/2004 | Chen | 83/455 |
| 7,131,363 | B2 * | 11/2006 | Tseng | 83/386 |
| 2006/0086227 | A1 * | 4/2006 | Shimizu | 83/651 |
| 2006/0162524 | A1 * | 7/2006 | Suzuki et al. | 83/485 |
| 2007/0125214 | A1 * | 6/2007 | Dong et al. | 83/485 |
| 2009/0013844 | A1 * | 1/2009 | Sudmalis et al. | 83/614 |

* cited by examiner

*Primary Examiner* — Phong Nguyen
(74) *Attorney, Agent, or Firm* — Morland C. Fischer

(57) ABSTRACT

A trimmer to cut a backing on which an overlay is mounted. The trimmer includes cutting blades and a removable fence that has a stop. The fence is carried by a pair of risers that are capable of moving relative to the work surface. A rotatable lever arm is coupled to the risers by a linking cam rod. When the lever arm and linking cam rod are rotated in a first direction, the risers move upwardly from the work surface and the stop of the fence is lifted upwardly and off the work surface to create a gap that enables the backing to move past the fence to the cutting blades to be trimmed. When the lever arm and linking cam rod rotate in an opposite direction, the risers move downwardly toward the work surface, and the stop is lowered against the backing to prevent the overlay from moving to the cutting blades.

11 Claims, 11 Drawing Sheets

PAPER TRIMMER WITH ADJUSTABLE STOP

BACKGROUND OF THE INVENTION

1. Field of the Invention

This invention relates to an easy-to-use, hand-operated paper trimmer having an adjustable stop so as to be adapted to accurately cut a backing on which an overlay (e.g., a photograph) is mounted such that neat and uniform borders will surround the overlay adjacent the side thereof.

2. Background Art

Collectors, photo albums keepers, scrapbook makers, and the like, frequently wish to mount an overlay (e.g., a photograph, postcard, certificate, etc.) on a relatively thick backing to provide support for and prevent damage to the overlay. On some occasions, the backing is too large to properly display the overlay mounted thereon. On other occasions, the border provided by the backing around the overlay is uneven so as to create a sloppy appearance which detracts from the overlay. An individual can use a scissors, paper cutter or hobby knife to cut the backing to size. However, unless considerable time and care is first expended to properly measure and mark the desired border around all sides of the overlay, the backing may be miscut which often leads to frustration and the need to remove the overlay for mounting on a new backing.

Accordingly, what is desirable is a compact, easy-to-use, hand-operated paper trimmer that is capable of quickly and accurately cutting a backing on which an overlay is mounted so that neat and uniform borders will extend around all sides of the overlay without the need to first measure and mark the border on the backing.

SUMMARY OF THE INVENTION

In general terms, a paper trimmer is disclosed that is capable of accurately cutting a backing made from paper, plastic, card board, and the like, on which an overlay (e.g., a photograph) is mounted. The trimmer includes a frame having a low-friction work surface along which the backing is moved towards upper and lower cutting blades. The upper cutting blade is attached to a rotatable cutting arm that is pivotally connected to one side of the frame, and the lower cutting blade is fixedly connected to the same side of the frame.

An adjustable fence having a stop lip which runs longitudinally across the work surface of the frame is removably connected to and carried by a pair of risers at opposite ends of the frame. The risers are displaced from an at-rest position recessed within the frame, at which the stop lip of the fence lies flush against the work surface of the frame so as to block the backing and the overlay thereon from moving past the fence, to an elevated position above the frame, at which the stop lip is lifted off the work surface of the frame and a gap is created between the stop lip and the work surface. The gap created between the stop lip and the work surface when the risers are in the elevated position is sized to be large enough to permit the backing to move past the fence to the cutting blades. However, when the risers return to the at-rest position, the stop lip of the fence will now lie upon the backing to prevent the overlay from moving past the fence to the cutting blades.

A manually-operated, rotatable lever arm is coupled to the risers by way of a linking cam rod that runs underneath the frame of the paper trimmer. A pair of cams are formed on and rotatable with the lever arm. The pair of cams communicate with respective ones of the pair of risers, such that a rotation of the lever arm is imparted through the linking cam rod to cause a corresponding linear displacement of the risers between the at-rest and elevated positions. More particularly, when the lever arm is rotated in a first direction in response to a pushing force applied thereto, the cams of the linking cam rod are also rotated in the first direction so as to apply a force to the risers, whereby the risers are caused to move upwardly from the at-rest position to the elevated position and the stop lip of the fence carried by the risers is lifted off the work surface of the frame.

When the lever arm rotates in an opposite direction, the cams of the linking cam rod are also rotated in the opposite direction to enable the risers to move downwardly from their elevated position to their at-rest position, whereby the stop lip of the fence is laid flush against the backing. Springs that are interfaced with respective risers are compressed and store energy when the cams are rotated by the linking cam rod in the first direction and the risers correspondingly move upwardly to the elevated position. The springs release the stored energy and expand to cause the risers to be pulled downwardly to the at-rest position when the cams are rotated in the opposite direction.

DESCRIPTION OF THE PREFERRED EMBODIMENT

Figure 1:
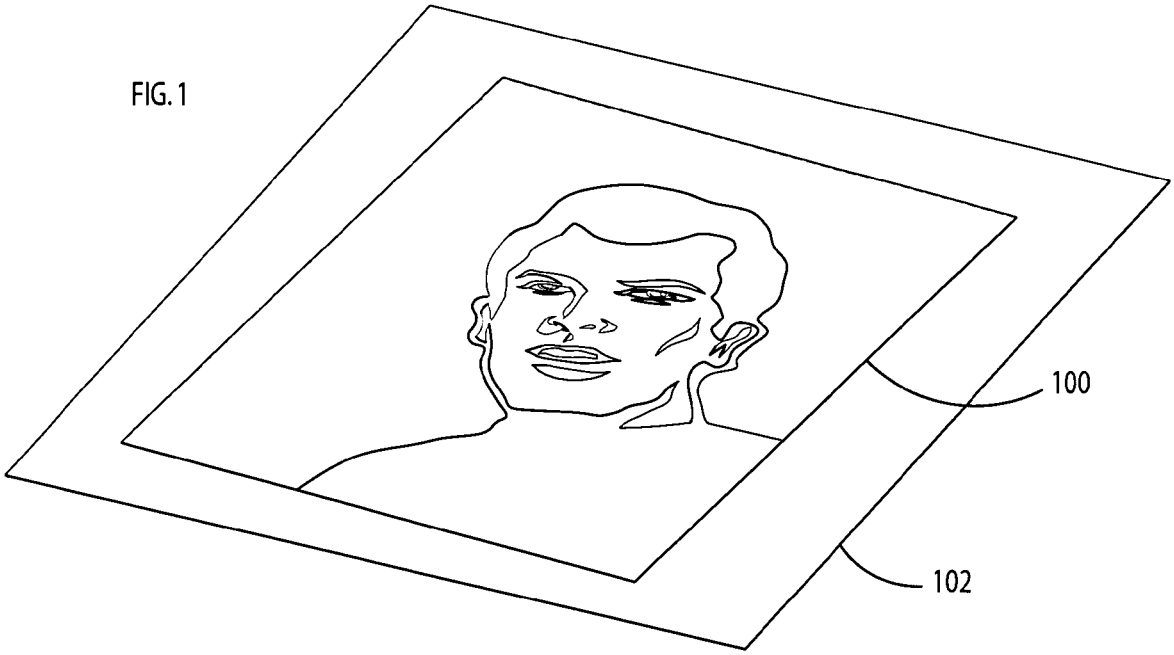
FIG. 1 is illustrative of an overlay (i.e., a photograph) randomly mounted on a backing such that uneven borders are provided around the overlay.
Figure 2:
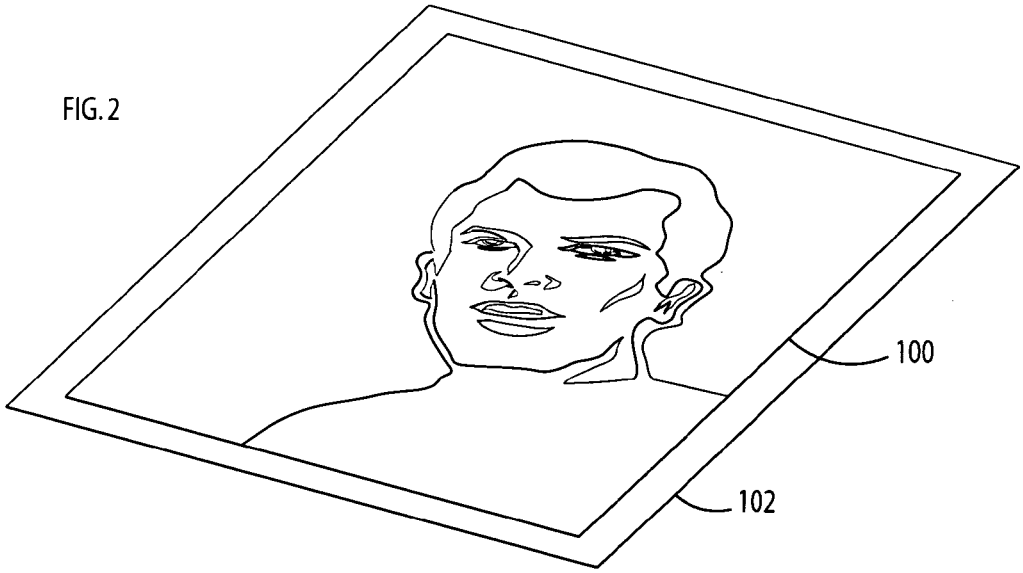
FIG. 2 shows the backing trimmed so as to provide neat and uniform borders around the overlay mounted on the backing.

Referring initially to FIGS. 1 and 2 of the drawings, there is shown an overlay (e.g., a photograph) 100 randomly mounted on a mat or similar backing 102 manufactured from paper, plastic, cardboard, or the like. In the case of FIG. 1, the backing 102 provides an uneven border around the overlay 100. In FIG. 2, the backing 102 has been trimmed such that a neat and even border now extends around the overlay 100. The foregoing is quickly and accurately accomplished by means of an easy-to-use, hand-operated paper trimmer in a manner that will now be disclosed.

Figure 3:
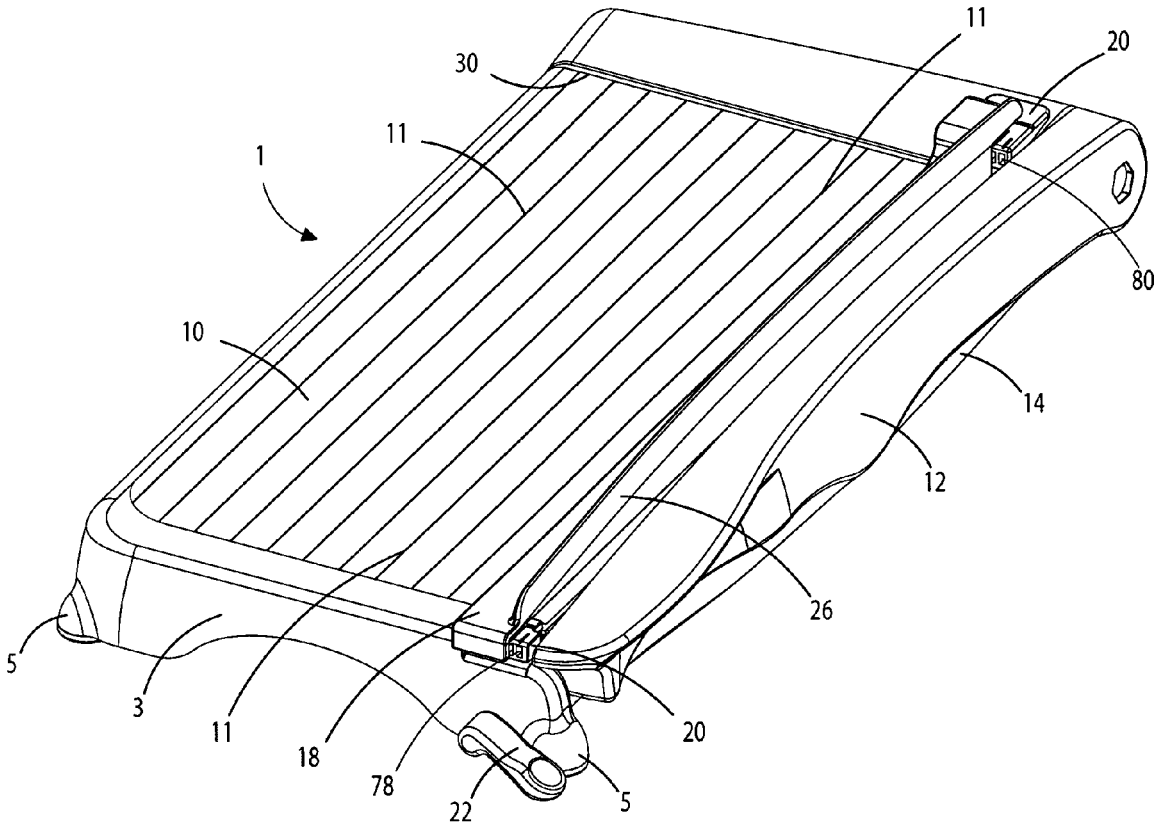
FIGS. 3 and 4 are perspective views of a paper trimmer according to a first preferred embodiment of this invention that is capable of trimming a backing on which an overlay is mounted to provide uniform borders around the backing in the manner shown in FIG. 2.
Figure 4:
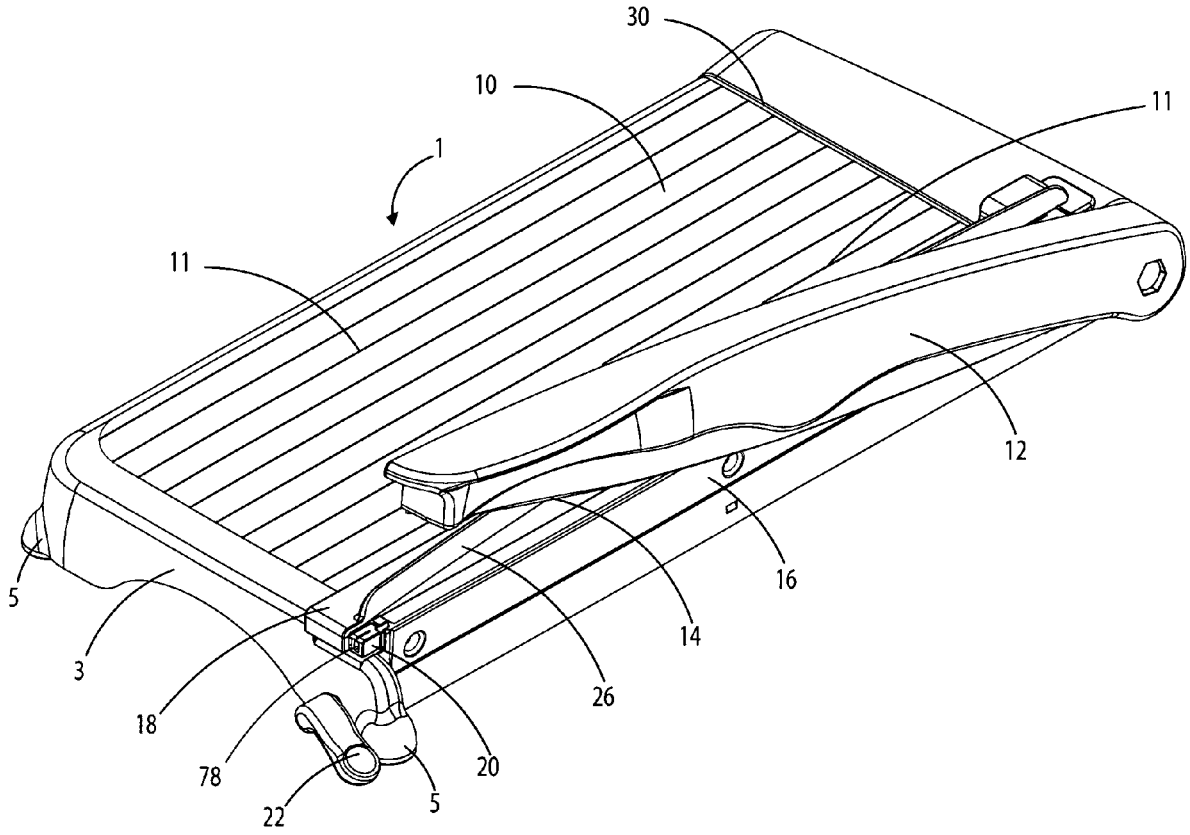

A compact, hand-operated paper trimmer 1 according to a first preferred embodiment of the present invention is initially described while referring to FIGS. 3 and 4 of the drawings. The paper trimmer 1 is preferably manufactured from an impact-resistant plastic, although the precise material from which paper trimmer 1 is manufactured is not to be considered a limitation of this invention. Paper trimmer 1 includes a continuous, generally rectangular frame 3 having a leg 5 located at each corner thereof. A cylindrical stabilizer post 9 (best shown in FIG. 5) projects downwardly from the underside of the frame 3. The legs 5 and stabilizer post 9 cooperate to support the frame 3 upon a flat surface, such as a table.

A low-friction (e.g., laminated) work surface 10 is located at the top of the frame 3. The work surface 10 can, if desired, can be used as an independent area on which a work piece is laid and cut by hand with a portable knife edge. The work surface 10 has a series of spaced parallel lines 11 printed thereon to enable a user to position the backing 102 of FIG. 1 relative to a cutting arm 12 so that the backing may be cut by paper trimmer 1 to achieve uniform borders as shown in FIG. 2.

The cutting arm 12 of paper trimmer 1 is pivotally connected to one side of the frame 3 so as to be rotatable relative to the frame. An upper cutting blade 14 (best shown in FIG. 16) is connected to and rotatable with the cutting arm 12. The cutting arm 12 and cutting blade 14 carried thereby are rotatable between a lower position of FIG. 3 lying against a side of frame 3 and a raised position of FIG. 4 extending above and making an angle with the frame 3. A fixed lower cutting blade 16 (best shown in FIG. 4) is connected to the same side of the frame 3 to which cutting arm 12 is pivotally connected so as to cooperate with the upper cutting blade 14 to cut a backing to a desired shape when the cutting arm 12 is lowered towards the frame 3 from its raised position of FIG. 4.

A removable fence 18 runs longitudinally across the work surface 10 along one side of the frame 3 of paper trimmer 1 adjacent the cutting arm 12. Opposite ends of the fence 18 are detachably connected to respective ones of a pair of risers 20 that are located at the front and back of the frame. As will soon be described, the risers 20 are movable upwardly relative to the frame 3 of paper trimmer 1 in response to the rotation of a manually-actuated lever arm 22. Prior to a rotation of the lever arm 22, the risers 20 are recessed (best shown in FIG. 8) so as to lie flush with the top of the frame 3.

The lever arm 22 which is accessible at the front of the paper trimmer 1 is coupled to each of the pair of risers 20 at opposite ends of the frame 3 by way of a linking cam rod 24 (best shown in FIG. 5) that runs longitudinally below the frame 3. A pushing force applied by a user causes the lever arm 22 to rotate downwardly in a clockwise direction (best shown in FIG. 9). The rotation of the lever arm 22 is imparted to the cam rod 24 and to a pair of spaced cams 38 (of FIGS. 7 and 8) formed thereon to cause the risers 20 to move upwardly from the frame 3 in a manner that will be disclosed in greater detail hereinafter. The upward movement of the risers 20 is communicated to opposite ends of the fence 18 which are attached to respective risers 20 so that the fence is moved from a downward position (best shown in FIG. 13) to an upward position (best shown in FIG. 15).

The fence 18 includes a vertical finger guard 26 which extends upwardly therefrom in perpendicular alignment with the work surface 10 at the top of the frame 3. The finger guard 26 prevents the fingers of a user from sliding over the work surface 10 and moving below the upper cutting blade 14 carried by the cutting arm 12. A stop lip 28 (also best shown in FIGS. 13 and 15) extends vertically downward from the fence 18 below the upwardly extending finger guard 26. As will be explained, prior to the user rotating the lever arm 22, the stop lip 28 of fence 18 lies flush against the work surface 10 to engage and block the backing 102 and the overlay 100 mounted thereon from moving past the fence 18. When a pushing force is applied to the lever arm 22 to cause a downward rotation of the lever arm and a corresponding upward displacement of the risers 20, the fence 18 attached to the risers 20 is moved upwardly from the work surface 10. In this case, the stop lip 28 of fence 18 is lifted off the work surface 10 in order to permit the backing 102 to move past the fence and between the upper and lower cutting blades 14 and 16 to be trimmed to size.

A back stop 30 runs laterally across the back of the frame 3 of paper trimmer 1 to lie in perpendicular alignment with the upper and lower cutting blades 14 and 16. The back stop 30 serves as a guide for directing the backing 102 along the work surface 10 towards the upper and lower cutting blades 14 and 16 to be trimmed thereby.

Figure 5:
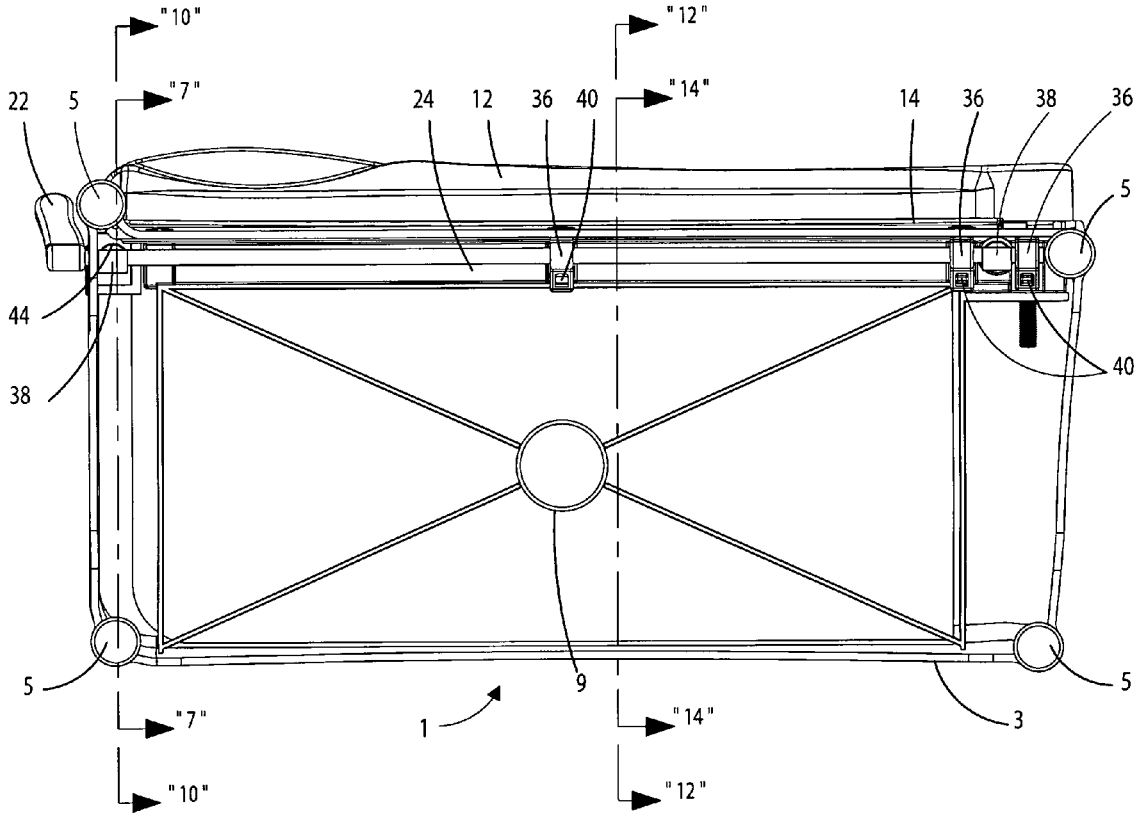
FIG. 5 is a bottom view of the paper trimmer of FIGS. 3 and 4.

FIG. 5 of the drawings shows the underside of the frame 3 of the paper trimmer 1 of FIGS. 3 and 4. As previously indicated, a linking cam rod 24 runs longitudinally below the frame 3 so as to be connected between and link the lever arm 22 with each of the risers (designated 20 in FIG. 3) at opposite ends of the frame 3. The cam rod 24 is held in place below the frame of paper trimmer 1 by means of snap-on clips 36 which surround and attach the cam rod 24 to the bottom of the frame 3 by way of clip stands (designated 40 and best shown in FIGS. 7 and 9) so as to permit the cam rod 24 to rotate with the lever arm 22. Spaced from one another at opposite ends of the cam rod 24 are integral cams 38 which communicate with respective ones of the risers 20. A rotation of the lever arm 22 causes a corresponding rotation of cam rod 24. The rotation of cam rod 24 is imparted to the cams 38. A rotation of cams 38 is translated into a linear displacement of the risers 20 relative to the frame 3 for a purpose that will soon be explained.

Figure 7:
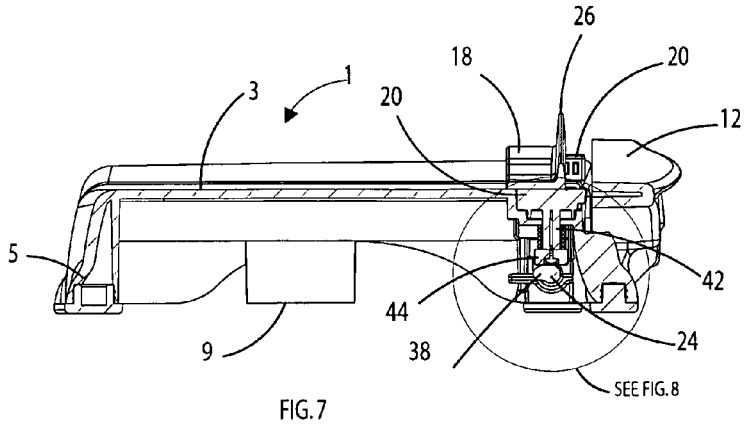
FIG. 7 is a cross section of the paper trimmer taken along lines 5-5 of FIG. 5.
Figure 8:
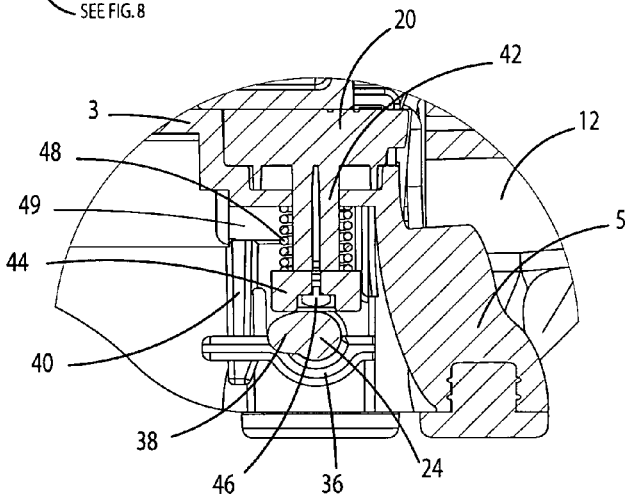
FIG. 8 is an enlarged detail of the paper trimmer taken from FIG. 7.
Figure 6:
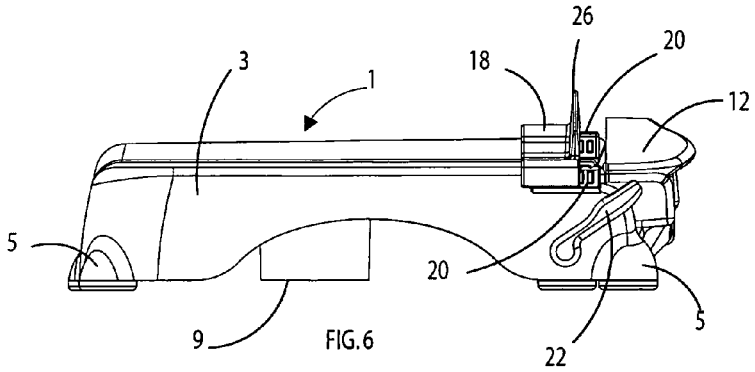
FIG. 6 is an end view of the paper trimmer of FIGS. 3 and 4.

FIGS. 6-11 of the drawings illustrate the manual manipulation of the lever arm 22 to control the rotation of the linking cam rod 24 and the cams 38 at opposite ends thereof so as to control the linear displacement of the risers 20 upwardly from the frame 3 of paper trimmer 1. As shown in FIGS. 6-8, when no downward pushing force is being applied to the lever arm 22 connected to cam rod 24, the cams 38 (only of which being shown) attached to and rotatable with cam rod 24 will lie at an inactive position.

The cam rod 24 communicates with each riser 20 by way of a relatively narrow riser shaft 42 and an end cap 44. The end cap 44 is connected to the riser shaft 42 by a retaining screw 46. Therefore, an upward pushing force applied to the end cap 44 in response to a rotation of a cam 38 with the cam rod 24 will be transmitted through shaft 42 to riser 20. To this end, a coil spring 48 surrounds the riser shaft 42 between end cap 44 and a spring pocket 49. In the case of FIGS. 6-8, when no pushing force is applied to the lever arm 22 and the cams 38 are in their inactive position, no upward pushing force will be applied by a cam 38 to an end cap 44. The spring 48 in spring pocket 49 is expanded and a downward pushing force is exerted on the end cap 44 to pull the riser 20 to its initial at-rest position recessed within the frame 3 of paper trimmer 1.

Figure 10:
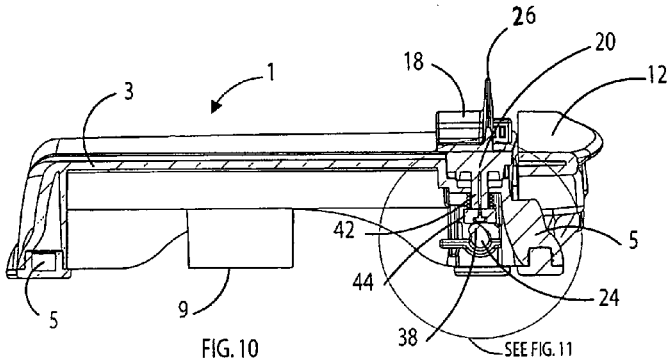
FIG. 10 is a cross section of the paper trimmer taken along lines 10-10 of FIG. 5.
Figure 11:
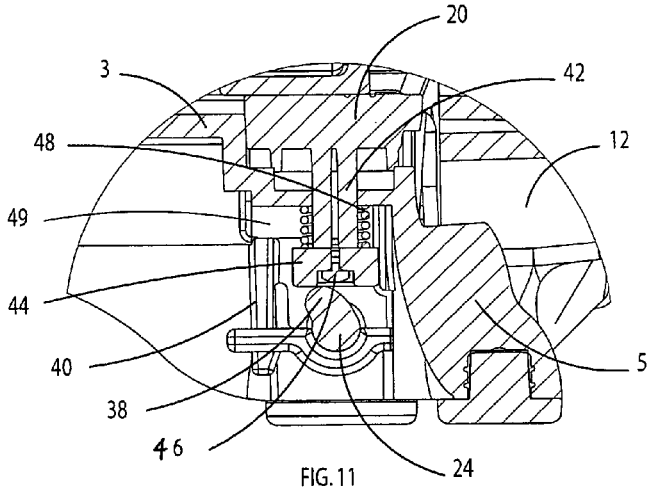
FIG. 11 is an enlarged detail of the paper trimmer taken from FIG. 10.
Figure 9:
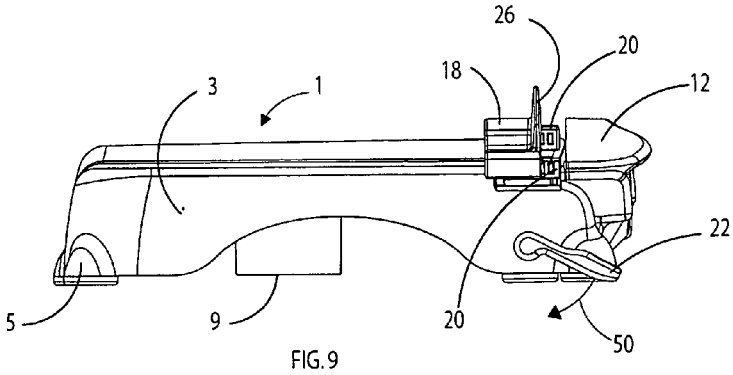
FIG. 9 is an end view of the paper trimmer with a downward pushing force applied to a lever arm thereof.

Turning now to FIGS. 9-11, a downward pushing force applied by the user causes a rotation of the lever arm 22 in the direction of reference arrow 50 of FIG. 9. As previously indicated, a rotation of lever arm 22 causes a corresponding rotation of the linking cam rod 24 as well as the cams 38 (only one of which being shown) from their inactive position (best shown in FIG. 8) to an active position (best shown in FIG. 11). A rotation of a cam 38 to the active position generates an axial upward pushing force against the end cap 44. The upward pushing force is transmitted from end cap 44, through the riser shaft 42, to riser 20. In the case of FIGS. 6-8, when a pushing force is applied to lever arm 22 and each cam 38 is rotated to its active position, the combination of an end cap 44, riser shaft 42, and riser 20 will be pushed upwardly as a unit. At the same time, the spring 48 around shaft 42 will be compressed between end cap 44 and spring pocket 49 so as to store energy. Accordingly, the riser 20 is subjected to a linear displacement to an elevated position above the frame 3 of paper trimmer 1 (best shown in FIG. 11) for an advantage that will soon be disclosed.

When the pushing force applied to lever arm 22 terminates, the compressed spring 48 surrounding shaft 42 will expand in spring pocket 49 and release its stored energy. Accordingly, a downward pushing force is now applied by spring 48 to the end cap 44 so that the riser 20 is pulled downwardly towards the frame 3 of paper trimmer 1 so as to return to its initial at-rest position (best shown in FIG. 8). The pushing force applied to end cap 44 causes a corresponding pushing force to be exerted against cam 38 which causes the cam 38 to return to its inactive position (of FIG. 8). Likewise, the lever arm 22 and the cam rod 24 connected thereto are automatically rotated back to their initial positions (of FIGS. 6-8).

Referring to FIGS. 12-15 of the drawings, details are provided concerning the ability of the risers 20 (only one of which being shown) at opposite ends of the frame 3 of paper trimmer 1 to lift the earlier-described removable fence 18 to its upward position above the work surface 10 of frame 3. As previously explained, the removable fence 18 includes an upwardly projecting finger guard 26 to intercept and block the user's fingers from moving past the fence and between the upper cutting blade 14 of cutting arm 12 and the lower cutting blade 16. Fence 18 also includes a downwardly projecting stop lip 28 which initially lies against the work surface 10 atop the frame 3 so as to intercept and block a backing (designated 102 on FIGS. 1 and 2) from sliding across the work surface 10 to the cutting blades 14 and 16.

Figure 14:
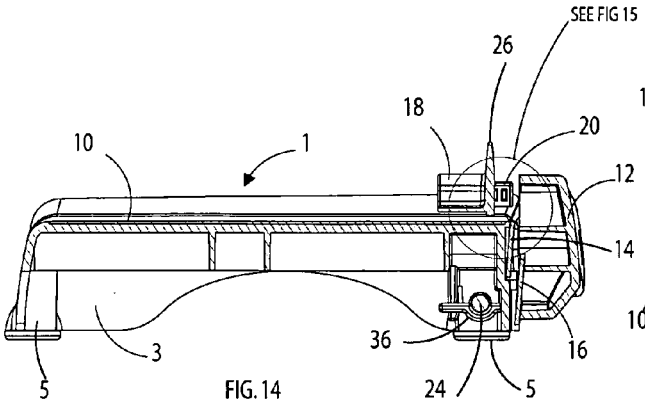
FIG. 14 is a cross section of the paper trimmer taken along lines 14-14 of FIG. 5.
Figure 15:
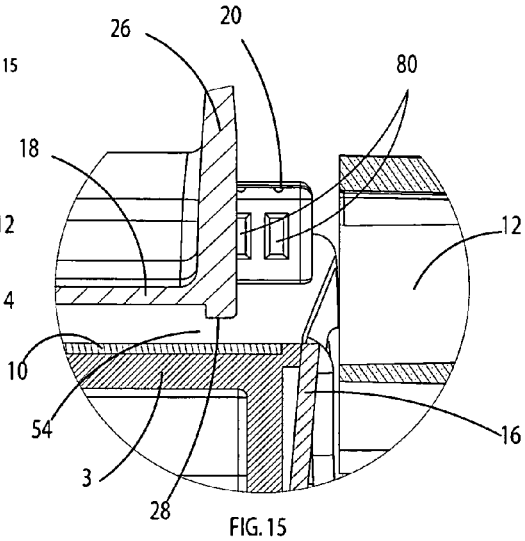
FIG. 15 is an enlarged detail of the paper trimmer taken from FIG. 14.
Figure 12:
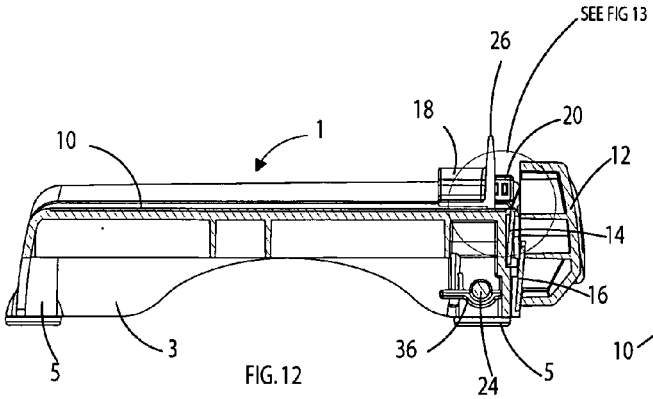
FIG. 12 is a cross section of the paper trimmer taken along lines 12-12 of FIG. 5.

As was just explained, a downward pushing force applied by the user to the lever arm 22 (of FIG. 11) of paper trimmer 1 causes a rotation of the linking cam rod 24 and cam 38 (of FIG. 10) which, in turn, causes a corresponding upward displacement of a respective riser 20 relative to the frame 3. Turning in this regard to FIGS. 14 and 15 of the drawings, the fence 18 is shown after the lever arm 22 has been rotated downwardly and the risers 20 (only one of which being shown) are displaced upwardly from the frame 3 to their elevated position. Inasmuch as the fence 18 is removably attached to and carried by the risers 20 located at opposite ends of the frame 3, a gap or space 54 is now created between the stop lip 28 of fence 18 and the work surface 10 of frame 3. The gap 54 established between the stop lip 28 and frame 3 with risers 20 in the elevated position above frame 3 is sized to be large enough to permit the backing 102 (of FIGS. 1 and 2) on which an overlay 100 is mounted to move past the fence 18 to the upper and lower cutting blades 14 and 16 for trimming.

Figure 13:
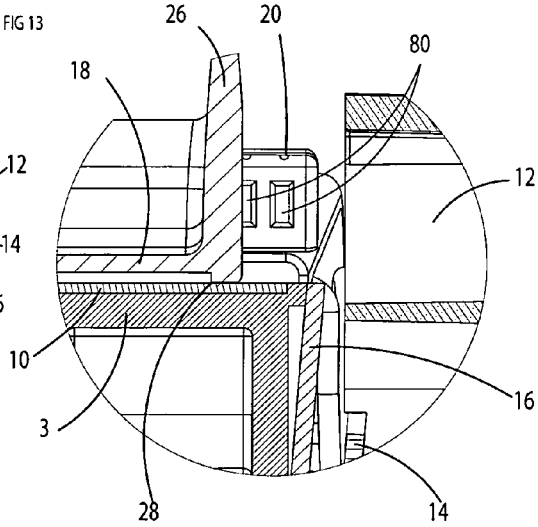
FIG. 13 is an enlarged detail of the paper trimmer taken from FIG. 12.

That is to say, with the risers 20 in the initial at-rest position and the stop lip 28 of fence 18 lying against the work surface 10 of frame 3 in the manner shown by FIG. 13, both the overlay 100 and the backing 102 (of FIGS. 1 and 2) are blocked from sliding over the work surface 10 and moving past the fence 18. However, when the risers 20 are displaced upwardly to the elevated position and the fence 18 is lifted off the frame 3 in response to a rotation of the lever arm 22 in the manner shown by FIG. 15, the backing 102 can be pushed past the fence 18 and toward the cutting blades 14 and 16 by way of the gap 54 between the stop lip 28 of fence 18 and the work surface 10 of the frame 3. At such time as when the downward pushing force applied to the lever arm 22 is terminated which, as previously explained, enables the risers 20 to be pulled downwardly from the elevated position to the initial at-rest position, the fence 18 carried by risers 20 will move downwardly towards the work surface 10. Hence, the stop lip 28 of fence 18 will now lie upon the backing 102 to prevent the overlay 100 mounted thereon from moving past the fence 18 to the cutting blades 14 and 16.

Figure 16:
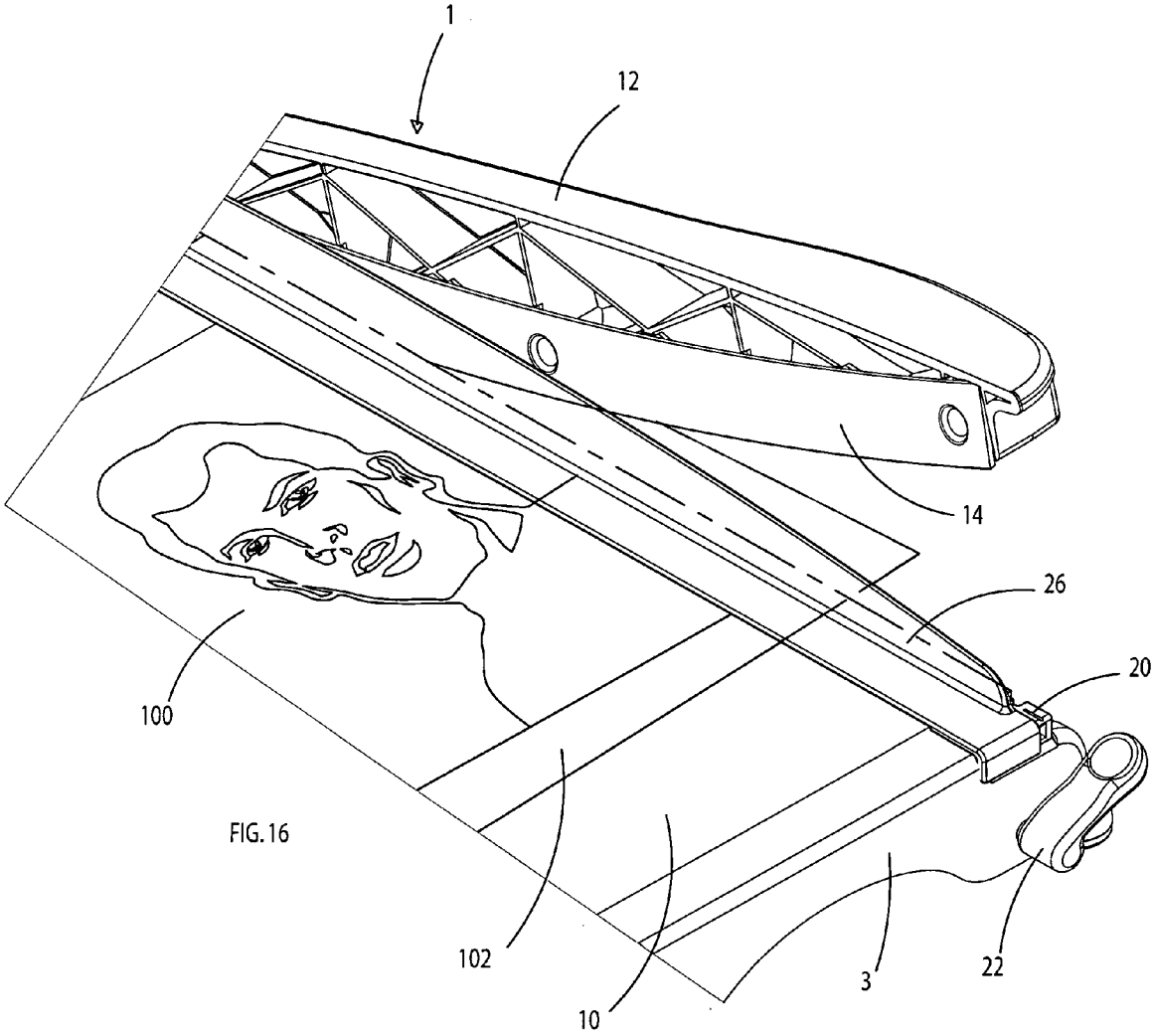
FIG. 16 shows a backing on which an overlay is mounted sliding under a removable fence in order to be cut by cutting blades of the paper trimmer after the fence is lifted above a work surface of the paper trimmer.

Thus, and referring to FIG. 16 of the drawings, only the backing 102 moves through the gap 54 and past the fence 18 in order to be trimmed by the paper trimmer 1. More particularly, when the cutting arm 12 is rotated upwardly to its raised position as shown, the user slides the backing 102 through the gap 54 (of FIG. 15) below fence 18 for receipt between the upper blade 14 carried by arm 12 and the lower cutting blade 16. When the cutting arm 12 is rotated downwardly to its initial lower position shown in FIG. 3, one side of the backing 102 will be trimmed. After the lever arm 22 is once again rotated to reestablish the gap 54 between the work surface 10 and the stop lip 28, the remaining three uneven sides of the backing 102 may then be pushed, one at a time, through the gap 54 and past the fence 18 for receipt between the upper and lower cutting blades 14 and 16, whereby all four sides will be evenly trimmed. However, the overlay 100 which does not move past the fence 18 will remain uncut. By virtue of the foregoing, the border surrounding the overlay 100 will be neat and of uniform dimension. In this same regard, the reference lines 11 (of FIGS. 3 and 4) that are printed on the work surface 10 over which the backing 102 is pushed can be used as position guides to selectively produce borders of varying size around the overlay 100 depending upon the wishes of the user.

Throughout FIGS. 1-16, the frame 3 of the paper trimmer 1 was shown and described as having a single, continuous work surface. However, as an alternate embodiment, illustrated in FIGS. 17-19 of the drawings is a paper trimmer 60 with a two-part frame having a pair of frame members 62-1 and 62-2 with respective work surfaces 64-1 and 64-2. The work surface 64-1 is preferably a self-healing craft mat, and the work surface 64-2 is preferably laminated to create a low friction sliding surface. The frame members 62-1 and 62-2 of paper trimmer 60 are pivotally connected together by means of a conventional hinge structure (not shown) so as to be rotatable towards and away from one another. Other features of the paper trimmer 60 are identical to features of the earlier-disclosed paper trimmer 1 and, therefore, identical reference numerals have been used in both cases. However, additional legs 5 are required to provide adequate support for the pair of frame members 62-1 and 62-2.

Figure 17:
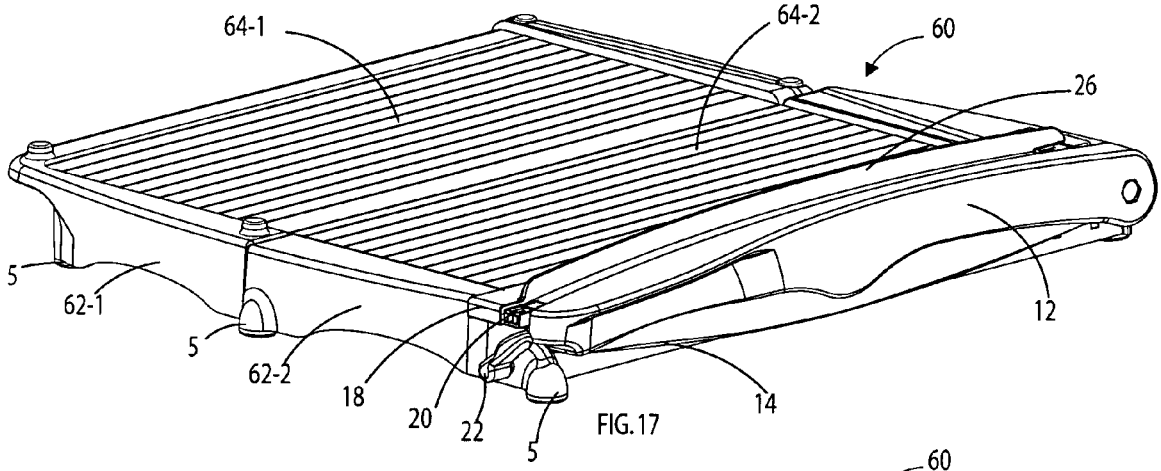
FIGS. 17-19 illustrate a paper trimmer according to a second preferred embodiment of this present invention having a pair of frame members that are pivotally coupled together and rotatable relative to one another between unfolded and folder configurations.
Figure 18:
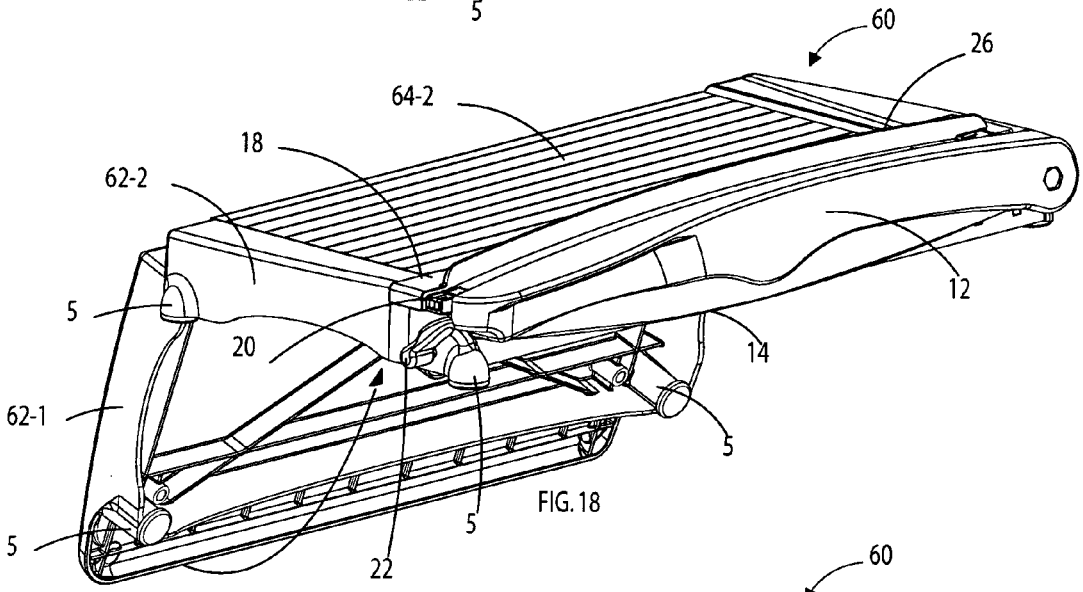
Figure 19:
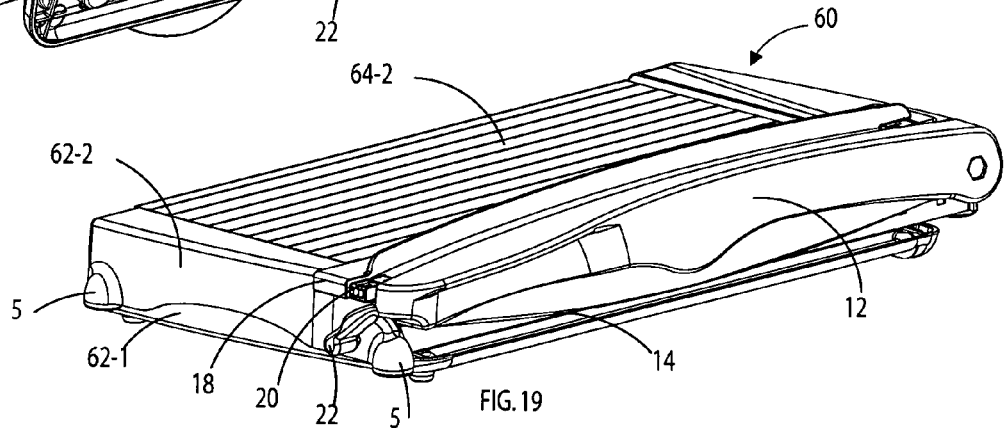

The paper trimmer 60 of FIGS. 17-19 may be advantageously folded to a compact configuration best shown in FIG. 19 suitable for transport or storage. To accomplish the foregoing, a first frame member 62-1 of the pair of frame members is rotated relative to the second frame member 62-2 from an unfolded configuration of FIG. 17 to a folded configuration of FIG. 19. The folded frame member 62-1 is sized so that in the folded configuration, frame member 62-1 is adapted to be received inwardly of the other frame member 62-2, whereby the respective work surfaces 64-1 and 64-2 lie one above the other. In this case, frame member 62-1 is held below the frame member 62-1 by means of magnets (not shown) or a close friction fit therebetween. Thus, the user will be given the option to use the paper trimmer 60 either in the folded configuration with a single smooth sliding work surface 64-2 on which to accommodate relatively small work pieces to be trimmed in the manner of paper trimmer 1 or in the unfolded configuration with a pair of work surfaces 64-1 and 64-2 that are coupled together and aligned end to end one another on which to accommodate larger work pieces.

As previously explained, each of the paper trimmers 1 and 60 of FIGS. 1-19 includes fence 18 that is removably attached to and carried by a pair of risers 20 that are located at opposite ends of the frame 3. Depending upon a rotation of the lever arm 22, the risers 20 are displaced between at-rest and elevated positions relative to the work surfaces 10 and 64-2 of paper trimmers 1 and 60 to correspondingly lift the fence 18 upwardly and off the work surface or lower the fence 18 downwardly against the work surface to control the movement of the backing 102, upon which the overlay 100 is mounted, past the fence. The manner in which the fence 18 is removably attached to risers 20 will now be described while referring to FIGS. 20-23 of the drawings.

Figure 22:
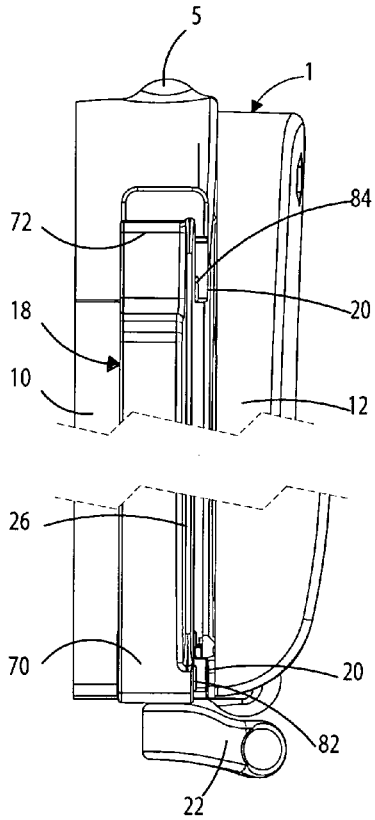
Figure 23:
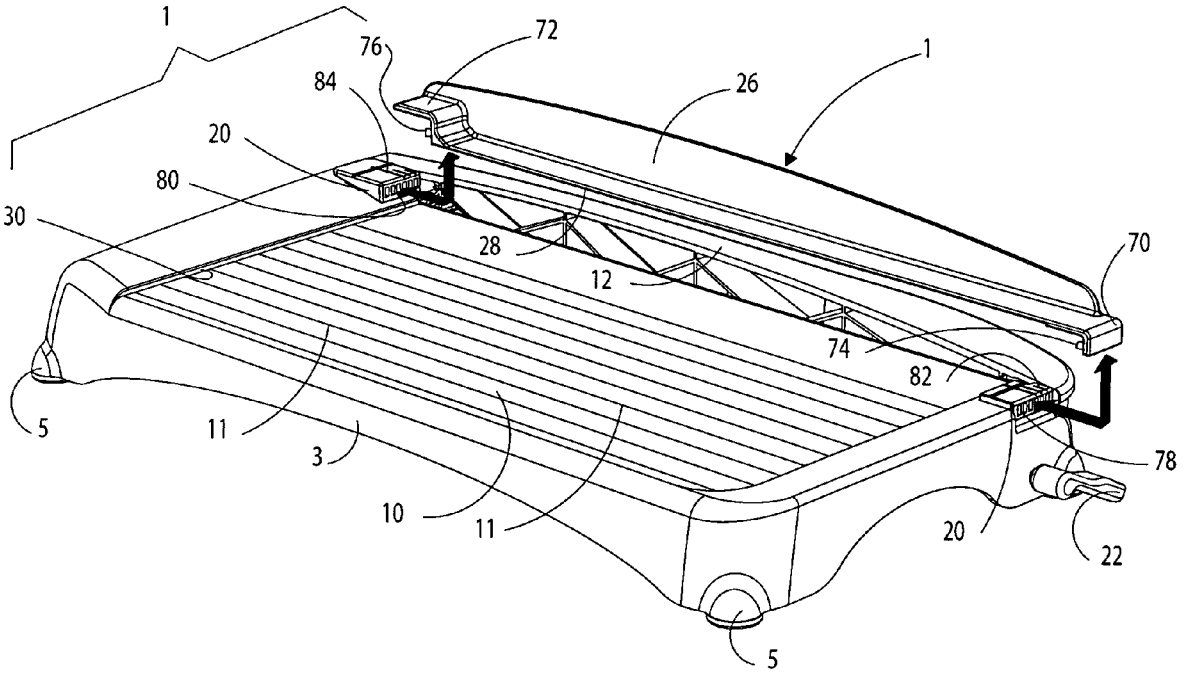

As is best shown in FIG. 23, and referring specifically to the paper trimmer 1 of FIGS. 1-16, the fence 18 includes first and opposites ends 70 and 72 to be detachably connected to respective risers 20. Each end 70 and 72 of the removable fence 18 includes a set of rearwardly projecting pins 74 and 76. Each riser 20 includes a corresponding set of pin receiving holes 78 and 80. In the assembled configuration of FIGS. 20-22, the pins 74 and 76 projecting from ends 70 and 72 of fence 18 are removably received within opposing pin holes 78 and 80 of risers 20 so that a linear displacement of the risers is transmitted to the fence 18 in response to a rotation of the lever arm 22.

Figure 20:
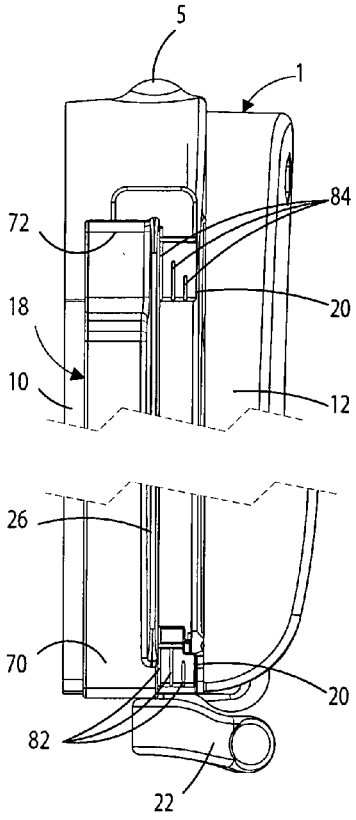
FIGS. 20-23 illustrate the adjustable nature of the removable fence carried by a pair of risers of the paper trimmer.
Figure 21:
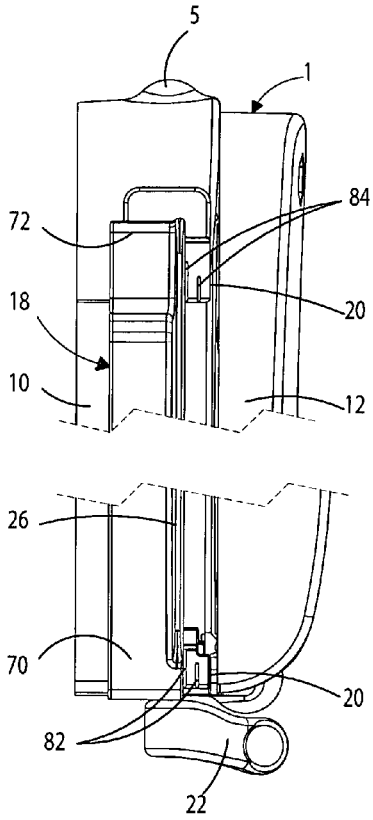

It may be desirable to adjust the position of the removable fence 18 relative to the cutting arm 12 located at one side of the frame 3 of paper trimmer 1 adjacent work surface 10. In this case, the ends 70 and 72 of fence 18 are detached from risers 20 by withdrawing the pins 74 and 76 from the pin holes 78 and 80. As is best shown in FIGS. 20-22, the ends 70 and 72 of fence 18 may then be reattached to the risers 20 with different ones of the pins 74 and 76 being removably received by different ones of the pin holes 78 and 80. Thus, some pins 74 and 76 will now be spaced from and remain outside the pin holes 78 and 80, such that some pin holes will be empty.

To facilitate a lateral relocation of the removable fence 18 relative to the cutting arm 12 of paper trimmer 1, a series of positioning marks (e.g., lines) 82 and 84 are inscribed in or printed on top of each riser 20. The positioning marks 82 and 84 are preferably spaced from one another at ⅛ inch intervals. The ends 70 and 72 of fence 18 are aligned with opposing axially-aligned positioning marks 82 and 84 on the spacers 20 so that the position of the removable fence 18 on the work surface 10 can be selectively adjusted according to the wishes of the user.

The invention claimed is:

1. A trimmer to cut a backing upon which an overlay is mounted so that the backing provides a uniform border around the overlay, said trimmer comprising:

a cutting blade by which to cut the backing;

a frame having a work surface along which the backing and the overlay mounted thereon move towards said cutting blade;

a stop;

a riser communicating with said stop, said riser being displaced from an at-rest position, at which said stop is located with respect to the work surface of said frame to intercept and prevent the backing and the overlay mounted thereon from moving past said stop to said cutting blade, to an elevated position, at which said stop is lifted by said riser above said work surface so that a gap is created between said stop and said work surface to permit the backing to move through said gap and past said stop to said cutting blade to be cut thereby, a rotatable control arm coupled to said riser, said rotatable control arm being rotated in a first direction to cause said riser to move to said elevated position, and said rotatable control arm being rotated in an opposite direction to cause said riser to move to said at-rest position; and a linking rod extending between said rotatable control arm and said riser such that a rotation of said rotatable control arm causes a corresponding rotation of said linking rod and a linear displacement of said riser relative to the work surface of said frame between said at-rest and elevated positions.

2. The trimmer recited in claim 1, wherein said stop is seated upon said riser to be displaced therewith, said riser being recessed within said frame in said at-rest position so that said stop lies flush against said work surface.

3. The trimmer recited in claim 1, further comprising a clip surrounding said linking rod and attaching said linking rod to said frame underneath the work surface thereof.

4. The trimmer recited in claim 1, wherein a cam is carried by and rotatable with said linking rod, said cam communicating with said riser and causing said riser to move upwardly and away from the work surface of said frame to said elevated position when said rotatable control arm is rotated in said first direction, and said cam enabling said riser to move downwardly towards said work surface to said at-rest position when said rotatable control rod is rotated in said opposite direction.

5. The trimmer recited in claim 4, further comprising an end cap, a shaft connected between said end cap and said riser, and a spring located in a spring pocket and surrounding said shaft, said cam communicating with said riser by way of said end cap and said shaft, said spring being compressed between said end cap and said spring pocket to store energy when said rotatable control arm rotates in said first direction and said cam rotates with said linking rod to cause said riser to move upwardly to said elevated position, and said spring releasing its stored energy and expanding when said rotatable control arm rotates in said opposite direction and said cam rotates with said linking rod to enable said riser to move downwardly to said at-rest position.

6. The trimmer recited in claim 1, wherein said stop includes a finger guard projecting upwardly from and extending above the work surface of said frame, said finger guard being sized to intercept and block the fingers of a user from moving past said stop to said cutting blade.

7. The trimmer recited in claim 1, wherein said stop is detachably connected to said riser, said stop being lifted by said riser relative to the work surface of said frame as said riser is displaced from said at-rest position to said elevated position.

8. The trimmer recited in claim 1, wherein the work surface of said frame includes first and second working areas aligned end to end and pivotally coupled to one another, one of said first and second working areas being rotatable relative to the other one of said working area so that said first and second working areas are disposed one above the other.

9. A trimmer to cut a backing upon which an overlay is mounted so that the backing provides a uniform border around the overlay, said trimmer comprising:

a cutting blade by which to cut the backing;

a frame having a work surface along which the backing and the overlay mounted thereon move towards said cutting blades;

a pair of risers to be displaced relative to the work surface of said frame from an at-rest position to an elevated position;

a stop detachably coupled to and movable with said pair of risers, said stop having first and opposite ends and at least one pin projecting from each of said first and opposite ends and each of said pair of risers having at least one pin hole within which to removably receive the respective pins projecting from the first and opposite ends of said stop, said risers being displaced from said at-rest position, at which said stop is located against said work surface to intercept and block the backing and the overlay mounted thereon from moving past said stop to the cutting blades, to said elevated position, at which said stop is lifted by said risers above said work surface so that a gap is created between said stop and said work surface to permit said backing to move through said gap and past said stop to said cutting blade to be cut thereby;

a rotatable control arm coupled to said pair of risers, said rotatable control arm being rotated in a first direction to cause said pair of risers to move from said at-rest position to said elevated position, and said rotatable control arm rotating in an opposite direction to cause said pair of risers to move to said at-rest position from said elevated position; and a linking rod extending between said rotatable control arm and each of said pair of risers such that a rotation of said rotatable control arm causes a corresponding rotation of said linking rod and a linear displacement of said pair of risers relative to the work surface of said frame between said at-rest and elevated positions.

10. The trimmer recited in claim 9, wherein a pair of cams are carried by and rotatable with said linking rod, said pair of cams communicating with respective ones of said pair of risers and causing said pair of risers to move upwardly and away from the work surface of said frame from said at-rest position to said elevated position when said rotatable control arm is rotated in said first direction, and said pair of cams enabling said pair of risers to move downwardly towards said work surface from said elevated position to said at-rest position when said rotatable control arm rotates in said opposite direction.

11. The trimmer recited in claim 10, further comprising an end cap, a shaft connected between said end cap and a first of said pair of risers, and a spring located in a spring pocket and surrounding said shaft, one of said pair of cams communicating with said first riser by way of said end cap and said shaft, said spring being compressed between said end cap and said spring pocket to store energy when said rotatable control arm rotates in said first direction and said one cam rotates with said linking rod to cause said first riser to move upwardly to said elevated position, and said spring releasing its stored energy and expanding when said rotatable control arm rotates in said opposite direction and said one cam rotates with said linking rod to enable said first riser to move downwardly to said at-rest position.

* * * * *